US007356860B2

(12) United States Patent
Yang

(10) Patent No.: US 7,356,860 B2
(45) Date of Patent: Apr. 15, 2008

(54) BEDDING STRUCTURE WITH COLLAPSIBLE FRAMES

(76) Inventor: Wei Hen Yang, 3F., No. 99, Yusheng St., Shihlin District, Taipei City 111 (TW)

( * ) Notice: Subject to any disclaimer, the term of this patent is extended or adjusted under 35 U.S.C. 154(b) by 302 days.

(21) Appl. No.: 11/284,826

(22) Filed: Nov. 23, 2005

(65) Prior Publication Data

US 2007/0113340 A1 May 24, 2007

(51) Int. Cl.
*A47G 9/02* (2006.01)
*A47G 9/08* (2006.01)

(52) U.S. Cl. ..... 5/486; 5/502; 5/482; 5/413 R

(58) Field of Classification Search ..... 5/413 R, 5/414, 417, 420, 482, 486, 494, 502, 500; 2/69, 69.5; 135/96
See application file for complete search history.

(56) References Cited

U.S. PATENT DOCUMENTS 2,055,044 A * 9/1936 Nelson ..... 135/125
2,179,424 A * 11/1939 Phillips et al. ..... 5/413 R
2,357,056 A * 8/1944 Nelson ..... 135/137
2,379,416 A * 7/1945 Clark ..... 5/413 R
2,572,490 A * 10/1951 Kaplan ..... 5/413 R
2,588,536 A * 3/1952 Kaplan ..... 5/413 R
2,932,833 A * 4/1960 Wambach ..... 5/656
3,751,741 A * 8/1973 Hendry ..... 5/413 AM
3,787,906 A * 1/1974 Hunt ..... 5/413 R
3,840,919 A * 10/1974 Middleton ..... 5/413 AM
3,857,125 A * 12/1974 Hunt ..... 5/413 R
3,878,574 A * 4/1975 Erickson ..... 5/413 R
3,959,834 A * 6/1976 Hunt ..... 5/413 R
3,988,791 A * 11/1976 Simon ..... 5/413 R
4,846,204 A * 7/1989 Sok Kyu ..... 5/113
4,896,387 A * 1/1990 Malcolm et al. ..... 5/413 R
5,657,497 A * 8/1997 Howe ..... 5/413 R
6,378,456 B1 * 4/2002 Jerome ..... 119/28.5
2007/0113340 A1 * 5/2007 Yang ..... 5/486

* cited by examiner

*Primary Examiner*—Robert G. Santos
(74) *Attorney, Agent, or Firm*—Troxell Law Office, PLLC

(57) ABSTRACT

A bedding structure with collapsible frames, comprising a limiting member, a covering member, and a plurality of frame members. The covering member is connected to the limiting member and has at least one opening. The plurality of frame members are configured in a predetermined arrangement inside the covering member. The frame member further consists of at least two arc curves with one arc curve in close proximity to the other arc curve at its overlapping end. The frame member further contains two adjoining ends in close proximity to the outer edge of limiting member to turn the overlapping end into essentially the highest point and prop up the covering member to a height away from the limiting member. Through the predetermined arrangement of the plurality of frame members inside the covering member, the plurality of overlapping ends are arranged to form roughly a predefined shape, and then through the alignment of frame members and the alignment of arc curves of the frame member, the bedding structure can be folded up for storage.

16 Claims, 9 Drawing Sheets

BEDDING STRUCTURE WITH COLLAPSIBLE FRAMES

BACKGROUND OF INVENTION

1. Field of the Invention

The present invention relates to a bedding structure, more particularly a kind of bedding with collapsible frames structure for folding and unfolding.

2. Description of the Prior Art

Average person spends a third of their life sleeping, which makes the comfort of bedding particularly important. But bedding with warm covering that feels comfortable when you lie down is not necessarily good bedding. The fabric used for the facing, content material, weaving method and colors are all key factors affecting the quality of sleep. Good choices of mattress, padding, bed sheet, pillow and blanket can be beneficial to health, and exquisitely designed and good quality sheets, blanket cover, pillow case, and bed spread are a way of life that provide relaxation and comfort to sleepers.

Mattress and blanket are the first things to consider in the choice of bedding. The selection of mattress should first determine the size desired, and then try it out. Good mattress should keep the spine in natural and relaxed state, which in combination with warm and soft blanket, gives the sleepers comfort and a sense of satisfaction.

Sleeping bag is an alternative for modern people. The working principle of sleeping bag is to wrap the user in an accommodation space to cut down the contact with outside environment that can reduce the absorption of user's body heat by outside environment, hence keeping the user warm. For the convenience of usage and storage, sleeping bags usually employ certain materials and have fixed thickness and simple style. In order to accommodate the shape of human body, the design of sleeping bag basically confines body movement. The proximity of sleeping bag interior to the body keeps the body warm, but it sometimes makes the user feel stuffy and even damp when perspiration moistens the bag.

Sleeping bag differs from other bedding in ease of carriage, use and storage. But the sultry feel and confined space for movement are the main reasons for its diminishing popularity. In fact, most tents, comforters and ball houses have the same drawbacks as sleeping bags. Aside from providing comfortable sleeping environment, bedding manufacturers have been working to enhance the functions of their products to meet consumer needs and set the goal of increasing the usage and market share of their products.

SUMMARY OF INVENTION

The primary object of the present invention is to provide a bedding structure with collapsible frames that can be folded and unfolded through the design of a plurality of flexural frames inside its covering member.

Another object of the present invention is to provide a bedding structure with collapsible frames that can be folded and unfolded by separating the framing structure from the coverage.

A further object of the present invention is to provide a bedding structure with collapsible frames that offers bigger accommodation space and ventilation through the prop up of covering member by framing structures therein.

Yet another object of the present invention is to provide a bedding structure with collapsible frames where the accommodation space formed by the covering member and limiting member allows babies to hide inside for game playing and a sense of security.

To achieve the aforesaid objects, the present invention provides a bedding structure with collapsible frames, comprising a limiting member, a covering member, and a plurality of frame members. The covering member is connected to the limiting member and has at least one opening. The plurality of frame members are configured in a predetermined arrangement inside the covering member. The frame member further consists of at least two arc curves with one arc curve in close proximity to the other arc curve at its overlapping end. The frame member further contains two adjoining ends in close proximity to the outer edge of limiting member to turn the overlapping end into essentially the highest point and prop up the covering member to a height away from the limiting member.

Through the predetermined arrangement of the plurality of frame members inside the covering member, the plurality of overlapping ends are arranged to form roughly a predefined shape, and then through the alignment of frame members and the alignment of arc curves of the frame member, the bedding structure can be folded up for storage.

BRIEF DESCRIPTION OF THE DRAWINGS

The details of the present invention will be more readily understood from a detailed description of the preferred embodiments taken in conjunction with the following figures.

DETAILED DESCRIPTION

Figure 1A:
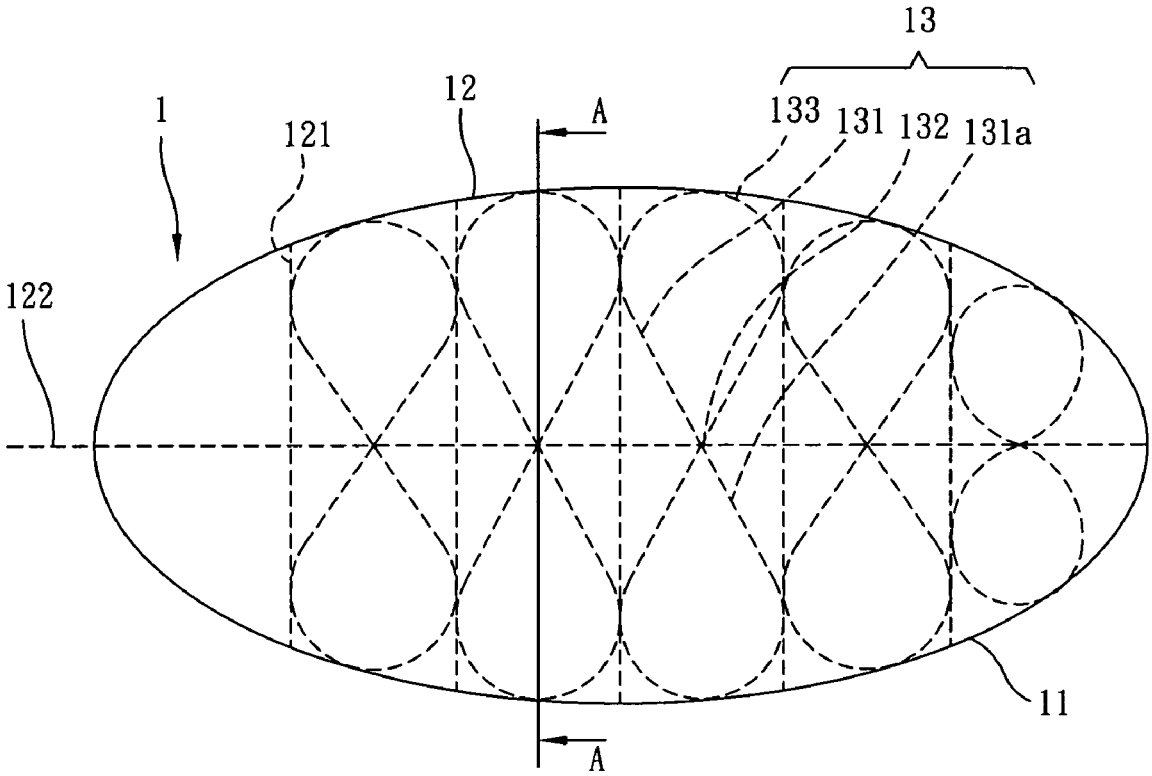
FIG. 1A is a top view of the bedding structure with collapsible frames according to a first embodiment of the invention.
Figure 1B:
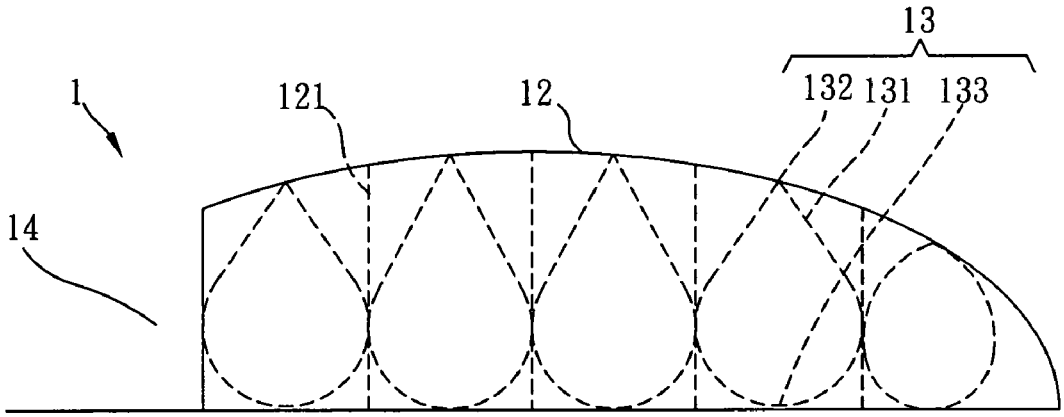
FIG. 1B is a front view of the bedding structure with collapsible frames according to a first embodiment of the invention.
Figure 1C:
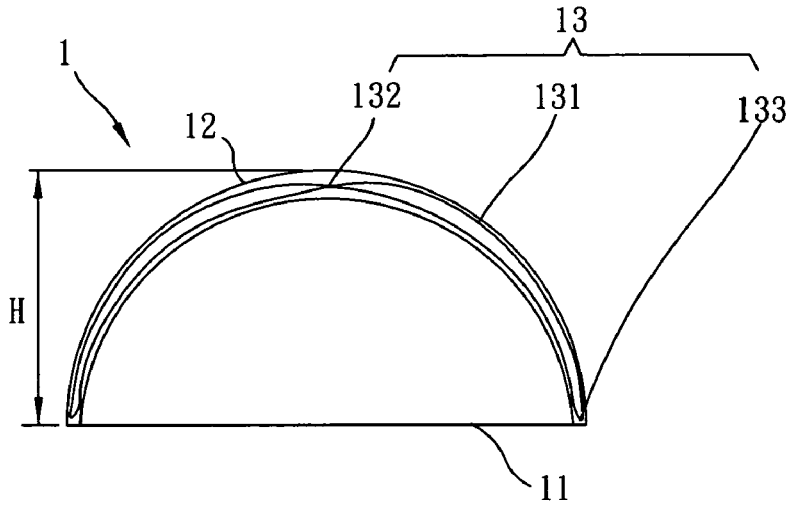
FIG. 1C is a A-A cross-sectional view of FIG. 1A.

Referring to FIG. 1A~FIG. 1C which show the structural diagrams of bedding structure with collapsible frames according to an embodiment of the invention. The bedding structure 1 of the invention comprises: a limiting member 11, a covering member 12, and a plurality of frame members 13. The limiting member 11 is a padding structure that can be placed on a flat surface, or at least a cord or at least an elastic band disposed around the outer edges of covering member 12 that pulling the limiting member 11 can bring the covering member 12 to protrude from the flat surface. The covering member 12 is connected to limiting member 11. In this embodiment, the covering member 12 connects to the limiting member 11 by a zipper. Naturally they can also be sewed together. The covering member 12 has at least an opening 14 that allows the passage of user (not shown in the figures) to enter and exit the bedding structure 1.

The plurality of frame members 13 are configured inside the covering member 12 in a predetermined arrangement. In this embodiment, the frame member 13 is an elastic construction with two ends linking together into a body or being a one-piece structure that turns frame member 13 into a round curved shape and then further into a figure eight knot structure by making a 180 degree rotation from one adjoining end 133. That is, the frame member 13 consists of at least two arc curves 131, 131*a*. One arc curve 131 is in close proximity to the other arc curve 131*a* through an overlapping end 132. The frame member 13 further contains two adjoining ends 133 that are against the outer periphery of limiting member 11, such that the overlapping end 132 becomes essentially the highest point. In addition, the frame member 13 through its own elasticity props up the covering member 12 to a height H away from the limiting member 11.

Figure 2A:
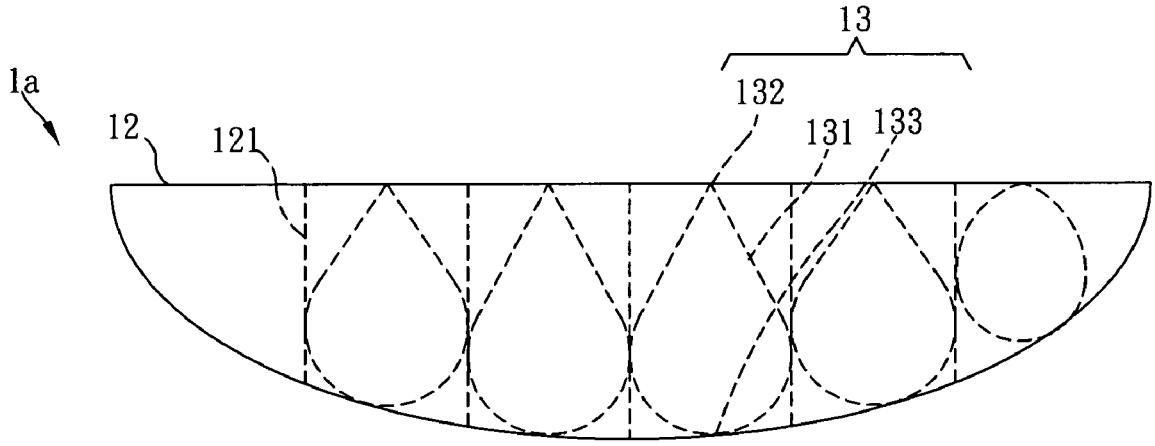
FIGS. 2A~2C show the folding motions of the bedding structure with collapsible frames according to a preferred embodiment of the invention.
Figure 2B:
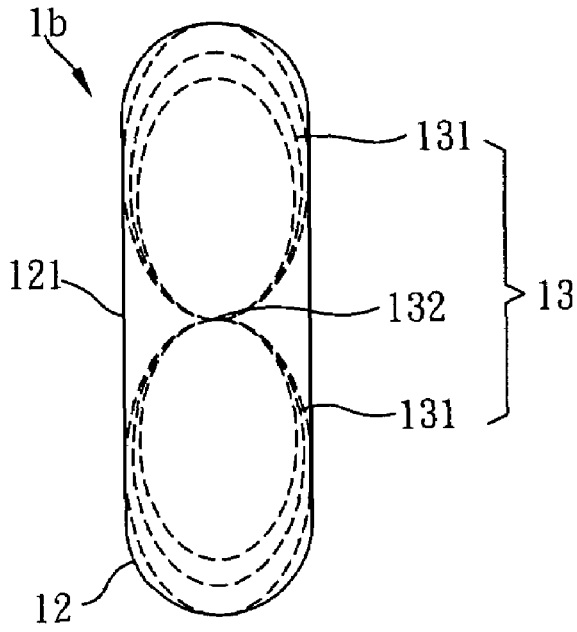
Figure 2C:
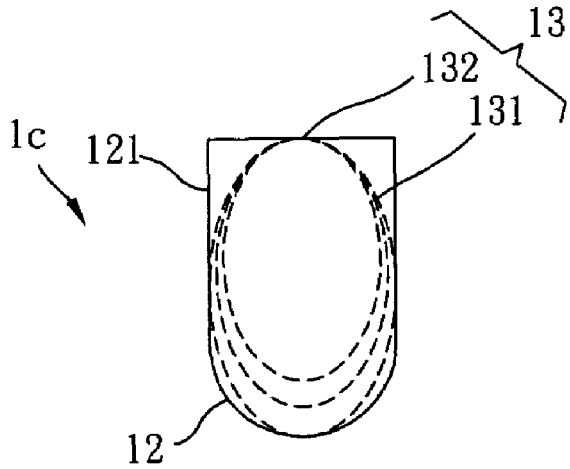

FIG. 2A to FIG. 2C show the folding motions of the bedding structure with collapsible frames according to a preferred embodiment of the invention. In this embodiment, the covering member 12 further consists of a plurality of confiners 121 parallelly arranged on covering member 12 to facilitate its support of limiting member 11. The confiner 121 can have a soft piece inside. With the arrangement described above, each frame member 13 is situated between two confiners 12, and the plurality of frame members 13 are configured inside the covering member 12 according to said predetermined arrangement. As such, the plurality of overlapping ends 132 are arranged in roughly a predefined shape 122 of a straight line or other forms. To fold the bedding structure 1, first as shown in FIG. 2A, align one arc curve 131 and the other arc curve 131*a* of frame member 13 such that covering member 12 folds along the extension of predefined shape 122 to turn bedding structure l*a* into roughly a semi-elliptical shape. Next align each and every frame member 13 such that the covering member 12 folds along the extension of confiner 121 into a bedding structure 1*c* as shown in FIG. 2C. Another way to fold up the bedding structure 1 as shown in FIG. 2B is to align each and every frame member 13 such that covering member 12 would fold along the extension of confiner 121 into a bedding structure 1*b*, and then align one arc curve 131 and the other arc curve 131*a* of frame member 13 such that covering member 12 folds along the extension of predefined shape 122 into a bedding structure 1*c* as shown in FIG. 2C.

Figure 3A:
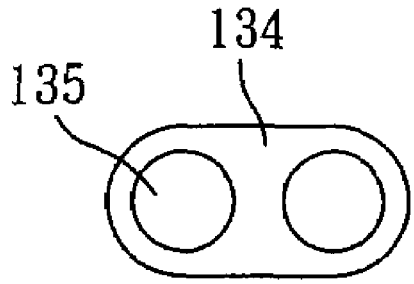
FIG. 3A is a top view of the positioning piece according to a preferred embodiment of the invention.
Figure 3B:
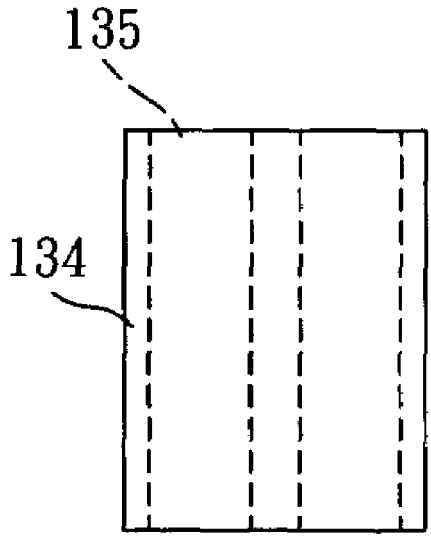
FIG. 3B is a front view of the positioning piece according to a preferred embodiment of the invention.

FIG. 3A and FIG. 3B show the structural diagrams of the positioning piece according to a preferred embodiment of the invention. In this embodiment, the frame member 13 further contains at least a positioning piece 134. Positioning piece 134 is an elastic construction that deforms upon the exertion of external force and restores to original shape upon the release of external force. The positioning piece 134 has at least two through holes 135. When the positioning piece 134 is disposed at the overlapping end 132, the two through holes are passed through by a single frame member 13 and overlap each other to connect to two arc curves 131, 131*a*. If the covering member 12 is not disposed with confiners 121, the plurality of frame members 13 can be positioned and connected by having a frame member 13 and another frame member to pass through respectively the two through holes 135 of positioning piece 134.

The other preferred embodiments described below have identical or similar elements to those described earlier. Those elements are assigned the same numeral (with only a English letter suffix for distinction purpose) and names and their detailed constitutions will not be elaborated.

Figure 4A:
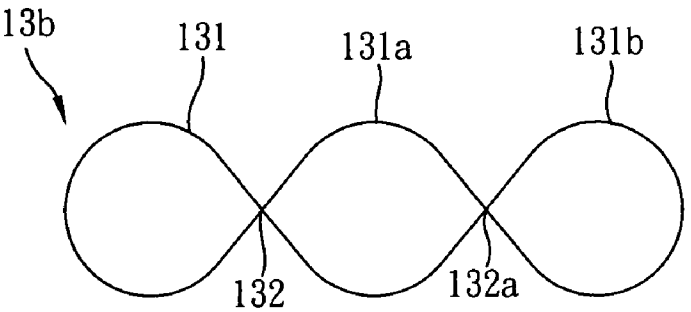
FIG. 4A is a top view of the frame member according to a second embodiment of the invention.
Figure 4B:
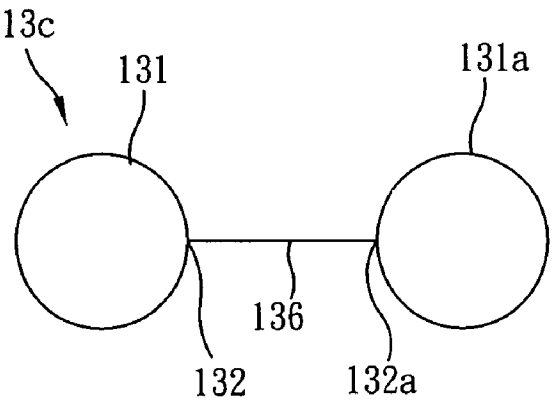
FIG. 4B is a top view of the frame member according to a third embodiment of the invention.
Figure 4C:
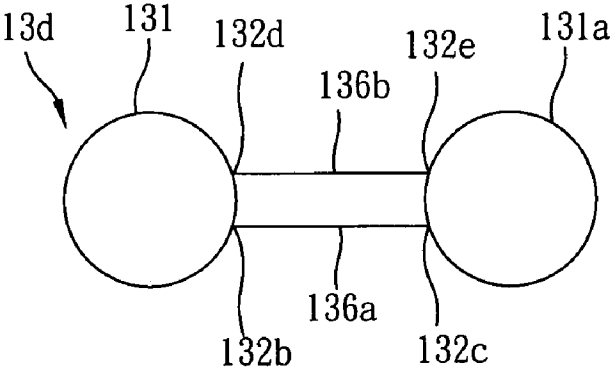
FIG. 4C is a top view of the frame member according to a fourth embodiment of the invention.
Figure 4D:
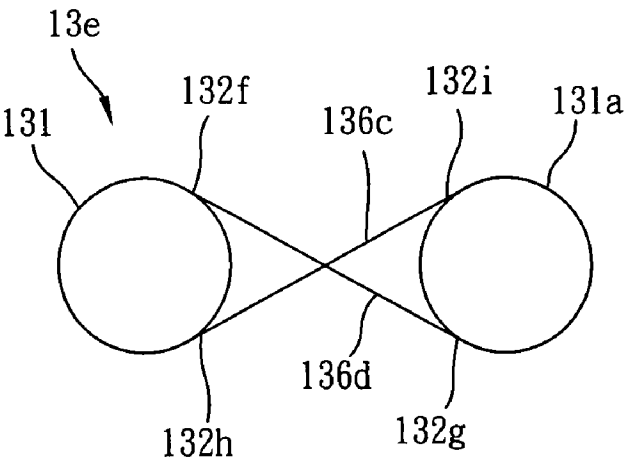
FIG. 4D is a top view of the frame member according to a fifth embodiment of the invention.

FIG. 4A through FIG. 4D are top view of the frame member in several embodiments of the invention where one arc curve 131 and the other arc curve 131*a* of the frame member 13 adjoin each other through a single overlapping end 132. As shown in FIG. 4A, frame member 13*b* has three arc curves 131, 131*a*, and 131*b*. Arc curve 131 adjoins another arc curve 131*a*with overlapping end 132, while another arc curve 131*a* adjoins yet another arc curve 131*b* through another overlapping end 132*a*. As shown in FIG. 4B, frame member 13*c* further contains at least a connecting piece 136, which connects to arc curves 131, 131*a* with overlapping ends 132, 132*a*. The frame member 13*d* shown in FIG. 4C has two connecting pieces 136*a*, 136*b*. Connecting piece 136*a* connects to the two arc curves 131, 131*a* through two overlapping ends 132*b*, 132*c*, while the other connecting piece 136*b*connects to the two arc curves 131, 131*a* with two overlapping ends 132*d*, 132*e*. The frame member 13*e* as shown in FIG. 4D has two crisscrossing connecting pieces 136*c*, 136*d*. Connecting piece 136*c* connects to two arc curves 131, 131*a* with two overlapping ends 123*f*, 132*g*, while the other connecting piece 136*d* connects to two arc curves 131, 131*a* with another two overlapping ends 132*h*, 132*i*. All modifications and alterations made according to the descriptions above by those familiar with the skill without departing from the essentials or the spirits and scope of the invention will not be elaborated here.

Figure 5A:
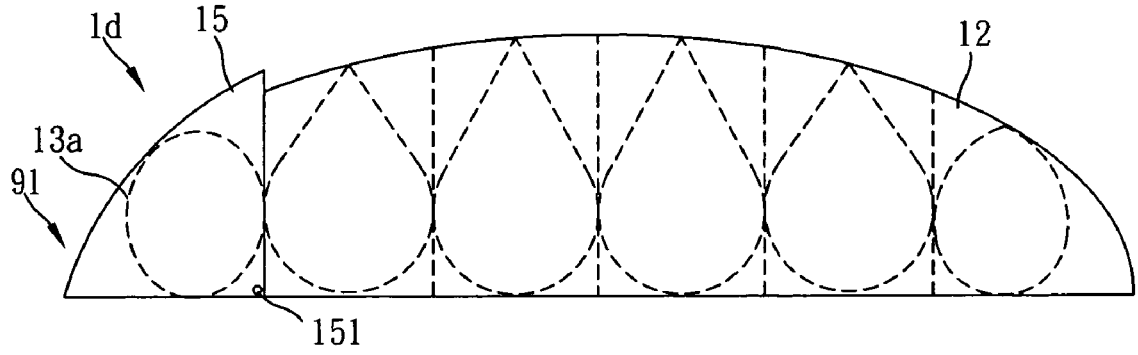
FIG. 5A is a front view of the first motion of movable frame member according to a preferred embodiment of the invention.
Figure 5B:
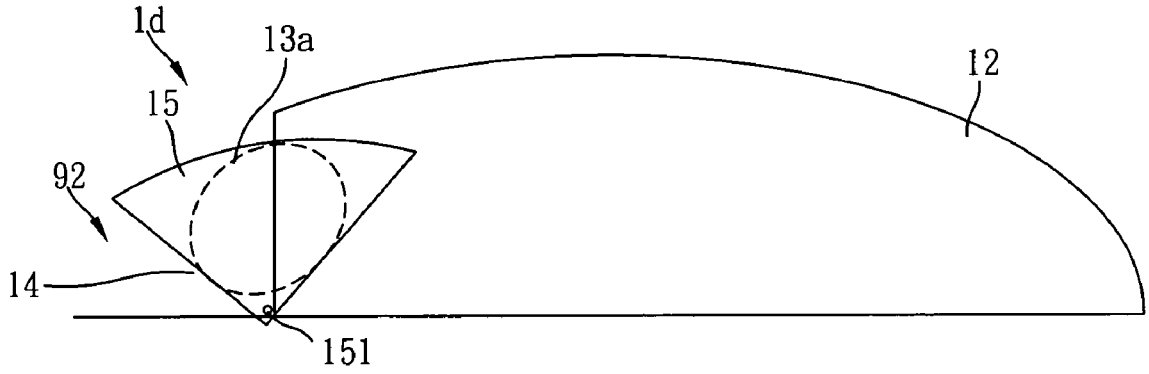
FIG. 5B is a front view of the second motion of movable frame member according to a preferred embodiment of the invention.

FIG. 5A and FIG. 5B show the front view of the motions of movable frame member according to a preferred embodiment of the invention. In this embodiment, the bedding structure 1*d* further contains a movable frame member 15 which connects to the covering member 12 with two connecting ends 151 and corresponds to the position of opening 14. The movable frame member 15 can also be disposed inside covering member 12 to become one piece, or be separated from covering member 12 and connected to it with two connecting ends 151. The movable frame part 15 can further contain at least one frame member 13*a* therein and line up with the plurality of frame members 13 inside the covering member 12 to in a predetermined arrangement, such that movable frame member 15 is folded at the same time when the bedding structure 1*d* is folded. The movable frame member 15 engages in rotational displacement along the axis of two connecting ends 151 to close the opening 14 when it is situated at first position 91, and open up opening 14 when it is situated at second position 92.

Figure 6A:
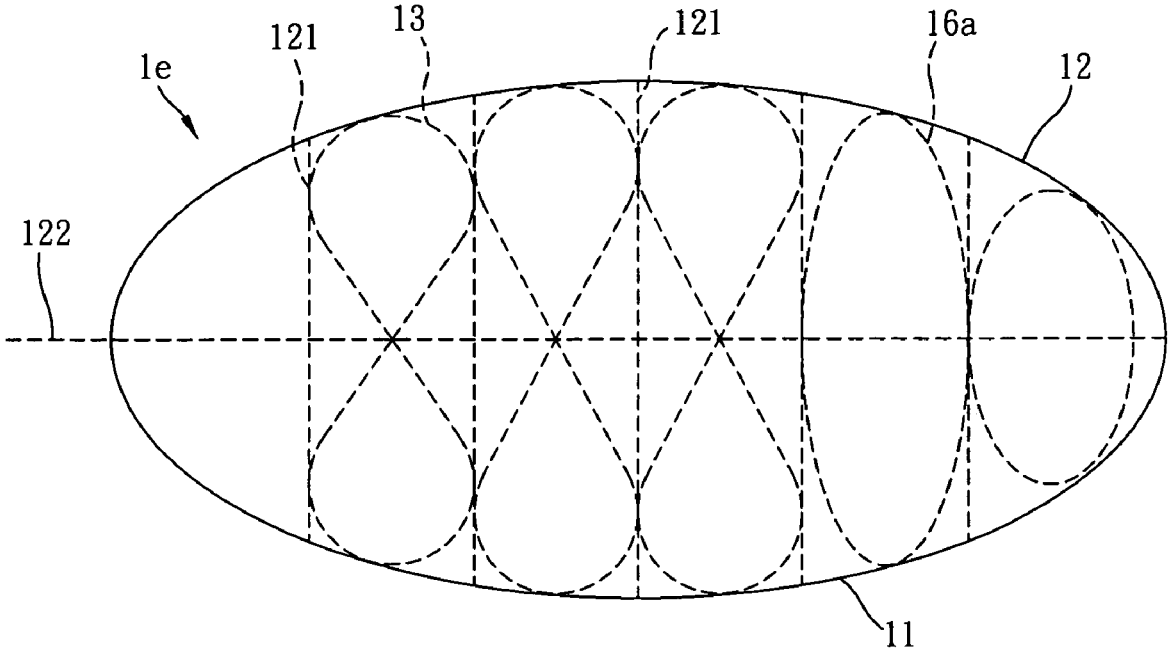
FIG. 6A is a top view of the auxiliary frame member according to a first embodiment of the invention.
Figure 6B:
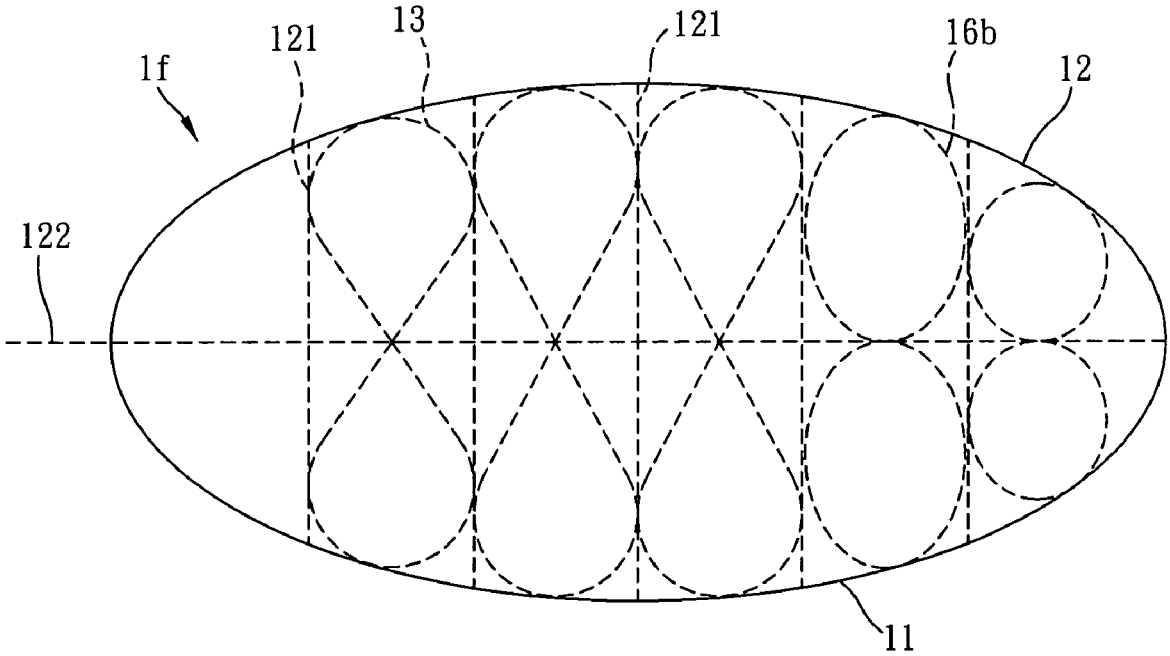
FIG. 6B is a top view of the auxiliary frame member according to a second embodiment of the invention.
Figure 6C:
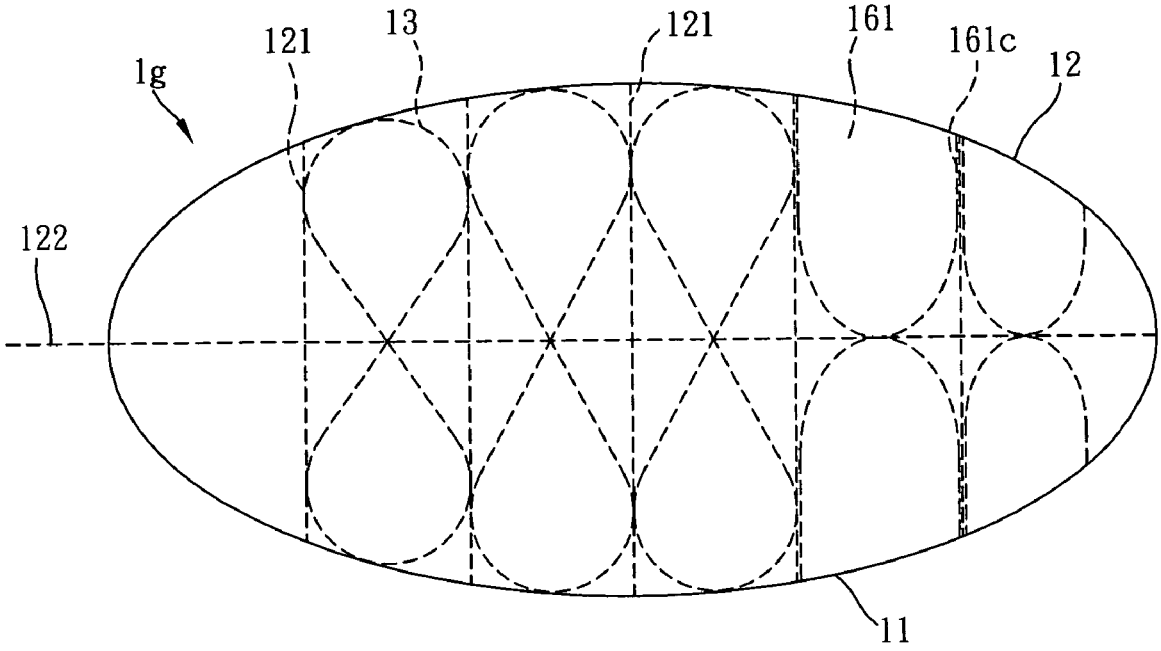
FIG. 6C is a top view of the auxiliary frame member according to a third embodiment of the invention.
Figure 6D:
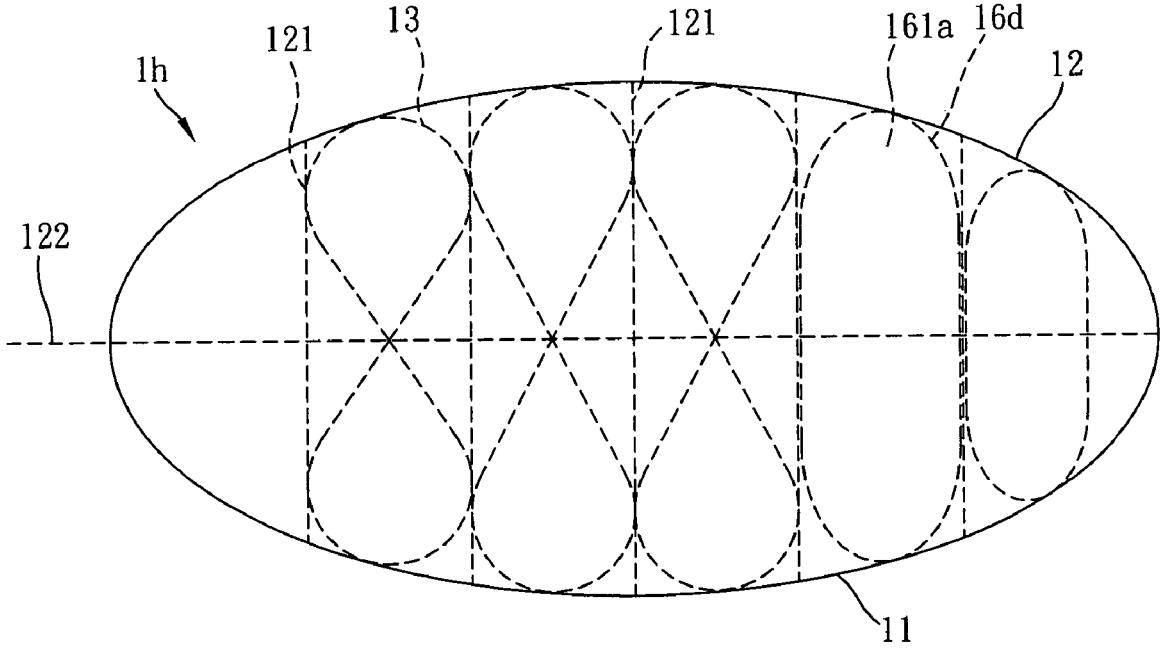
FIG. 6D is a top view of the auxiliary frame member according to a fourth embodiment of the invention.

FIG. 6A to FIG. 6D show the top view of the motions of auxiliary frame member according to a preferred embodiment of the invention. In those embodiments, the covering member 12 is not only provided with a plurality of frame members 13, the bedding structure 1 further contains at least one auxiliary frame member 16. The auxiliary frame member 16 is an elastic construction and disposed inside covering member 12. As shown in FIG. 6A, the auxiliary frame member 16*b* has a ring shape with both ends adjoining the outer edge of limiting member 11. Thus bedding structure 1*e* can be folded up by aligning all frame members 13 and all auxiliary frame members 16*a* and folding along the extension of predefined shape 122. As shown in FIG. 6B, the auxiliary frame member 16*b* has a ring shape with both ends adjoining the outer edge of limiting member 11 and the extension of predefined shape 122. Thus bedding structure 1*f* can be folded up by aligning each frame member 13 with each auxiliary frame member 16*b*, and aligning pairs of arc curve 131 and another arc curve 131*a* of frame member 13 with auxiliary frame members 16*b*. In FIG. 6C, the auxiliary frame member 16*c* has an opening 161, which corresponds to the outer edge of limiting member 11. Bedding structure 1*g* is folded up the same way as bedding structure 1*f*. As shown in FIG. 6D, the auxiliary frame member 16*d*has an opening 161*a*, which corresponds to the extension of predefined shape 122. Bedding structure 1*h* is also folded up the same way as bedding structure 1*f*. The auxiliary frame member 16*c* with an opening 161 can also be designed as one of the two confiners 121 in FIG. 6A. All modifications and alterations made according to the descriptions above by those familiar with the skill without departing from the essentials or the spirits and scope of the invention will not be elaborated here.

Figure 7A:
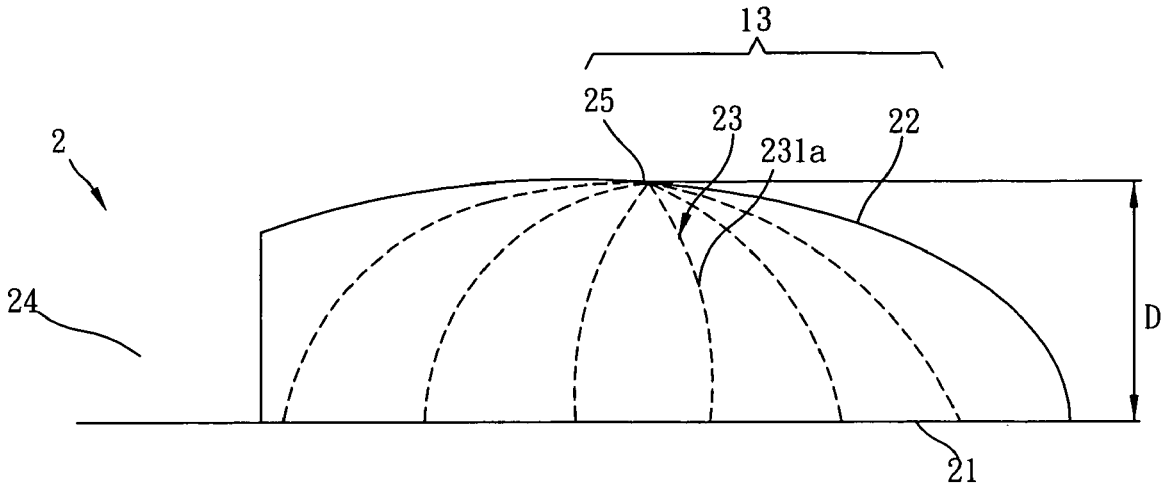
FIG. 7A is a top view of the bedding structure with collapsible frames according to a second embodiment of the invention.
Figure 7B:
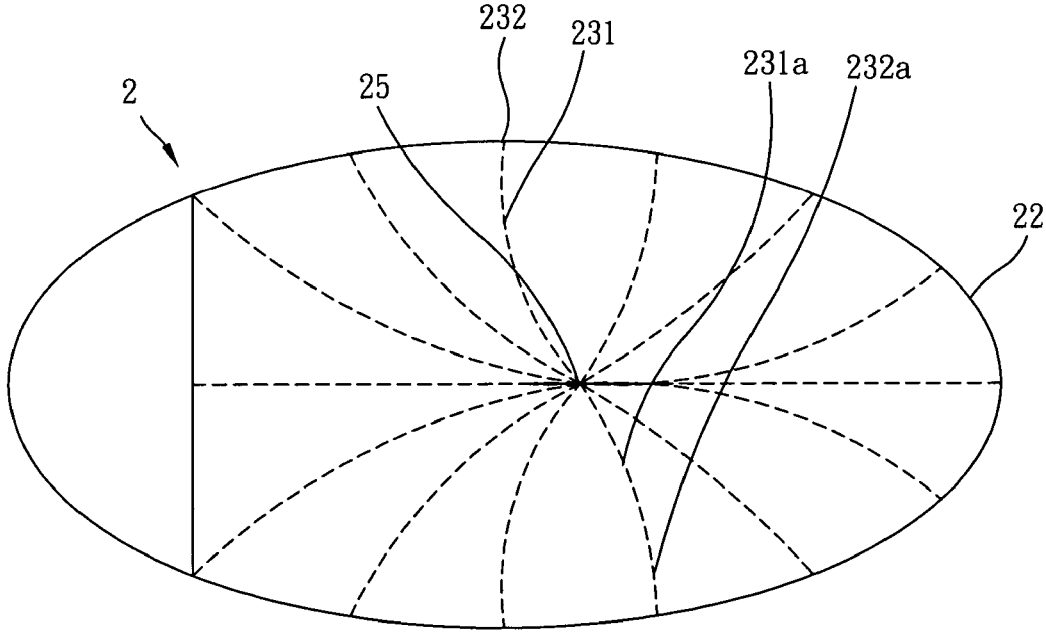
FIG. 7B is a front view of the bedding structure with collapsible frames according to a second embodiment of the invention.

FIG. 7A and FIG. 7B show the structural diagram of the bedding structure with collapsible frames according to a second embodiment of the invention. In this embodiment, bedding structure 2 comprises a limiting member 21, a covering member 22, and a plurality of frame members 23. The covering member 22 is connected with limiting member 21, and has at least one opening 24. The opening 24 allows the passage of user in and out of the bedding structure 2. The plurality of frame members 23 are radially arranged inside the covering member 22. The frame members 23 are elastic constructions and formed in one piece. Thus when the plurality of frame members 23 converge at a center end 25, the frame members 23 further contains two supporting bodies 231, 231*a* situated respectively at each side of the center end 25, and the two supporting bodies adjoin the outer edge of limiting member 21 with an apex 232, 232*a* respectively, so that the center end 25 becomes essentially the highest point. By confining the apexes 232, 232*a* to keep them close against the outer edge of limiting member 21, the frame member 23 can prop up with elastic force the covering member 22 to a distance D away from the limiting member 21. In another embodiment, the frame member 23, the same as the aforementioned implementation, further contains at least two arc curves with one arc curve adjoining the other arc curve at the center end, and the plurality of frame members 23 converge at center end 25. All modifications and alterations made according to the descriptions above by those familiar with the skill without departing from the essentials or the spirits and scope of the invention will not be elaborated here. Bedding structure 2 can be folded up by aligning each frame members 23 and the supporting bodies 231, 231*a* of frame member 23. The center end 25 can also be provided with a positioning piece 134 as shown in FIG. 3A and FIG. 3B for connecting the plurality of frame members 23.

The bedding structure with collapsible frames according to the invention offers at least the following advantages:

1. It provides bedding functions.
2. The covering does not touch the user's body to lessen the feel of stuffiness and dampness.
3. The special frame design allows the bedding structure to be folded up and assembled quickly.
4. It can be used as a game tool for children.
5. The accommodation space provided by the bedding structure satisfies the mentality of small children to hide, while giving them a sense of security and allowing them to play.

The preferred embodiments of the invention have been disclosed above, which however should not be construed as a limitation on the actual application of the invention. Sleeping bags, tents, blankets and ball rooms all can offer the same features based on the embodiments of the invention. Hence all modifications and alterations made by those familiar with the skill without departing from the spirits of the invention and appended claims shall remain within the protected scope of the invention.

What is claimed is:

1. A bedding structure with collapsible frames, comprising a limiting member;

a covering member connected to the limiting member and having at least one opening; and a plurality of frame members provided inside the covering member in a predetermined arrangement; the frame members each further consists of at least two arc curves, at least an overlapping end and two adjoining ends; the two adjoining ends are respectively in close proximity to the outer edge of limiting member to turn the at least an overlapping end into essentially the highest point and prop up the covering member to a height away from the limiting member;

where by providing the plurality of frame members inside the covering member in a predetermined arrangement, the plurality of overlapping ends are arranged roughly into a predefined shape, and then by aligning the frame members and aligning the arc curves of frame members, the bedding structure can be folded up.

2. The bedding structure with collapsible frames according to claim 1, wherein said covering member further contains a plurality of confiners to keep a frame member therebetween.

3. The bedding structure with collapsible frames according to claim 2, wherein when the frame members align with each other, the bedding structure folds along an extension of said confiner.

4. The bedding structure with collapsible frames according to claim 1, wherein when the arc curves of each frame member align with each other, the bedding structure folds along an the extension of said predefined shape.

5. The bedding structure with collapsible frames according to claim 1, wherein said frame member is an elastic construction such that by confining the two adjoining ends to keep them close against the outer edge of limiting member, the frame member can prop up the covering member by elastic force to a height away from the limiting member.

6. The bedding structure with collapsible frames according to claim 1, further comprising a movable frame member connected to the covering member with two connecting ends and corresponding to the opening.

7. The bedding structure with collapsible frames according to claim 1, further comprising at least an auxiliary frame member provided inside the covering member.

8. The bedding structure with collapsible frames according to claim 7, wherein said auxiliary frame member has a ring shape with two ends adjoining the outer edge of limiting member respectively.

9. The bedding structure with collapsible frames according to claim 7, wherein said auxiliary frame member has a ring shape with two ends adjoining the outer edge of limiting member respectively and the extension of predefined shape.

10. The bedding structure with collapsible frames according to claim 7, wherein the auxiliary frame member has an opening corresponding to the outer edge of limiting member.

11. The bedding structure with collapsible frames according to claim 7, wherein the auxiliary frame member has an opening corresponding to the extension of predefined shape.

12. The bedding structure with collapsible frames according to claim 1, wherein said limiting member is a padding that can be laid on a flat surface.

13. The bedding structure with collapsible frames according to claim 1, wherein said limiting member is made of at least a cord.

14. The bedding structure with collapsible frames according to claim 1, wherein said limiting member is made of at least a stretching band.

15. The bedding structure with collapsible frames according to claim 1, wherein one arc curve adjoins the other arc curve at least an overlapping end.

16. The bedding structure with collapsible frames according to claim 1, wherein said frame member further contains at least a connecting piece; the connecting piece connects to two arc curves with overlapping ends respectively.

* * * * *